US012571271B2

(12) United States Patent
Nguyen et al.

(10) Patent No.: US 12,571,271 B2
(45) Date of Patent: Mar. 10, 2026

(54) MILL, WHIPSTOCK, AND ANCHOR ASSEMBLY, METHOD AND SYSTEM

(71) Applicant: Baker Hughes Oilfield Operations LLC, Houston, TX (US)

(72) Inventors: Tuan Nguyen, Pearland, TX (US); James Scott Trahan, Magnolia, TX (US); David Alexander, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 18/816,695

(22) Filed: Aug. 27, 2024

(65) Prior Publication Data

US 2026/0063008 A1 Mar. 5, 2026

(51) Int. Cl.
*E21B 23/01* (2006.01)
*E21B 47/06* (2012.01)

(52) U.S. Cl.
CPC ..... *E21B 23/01* (2013.01); *E21B 47/06* (2013.01)

(58) Field of Classification Search
CPC ..... E21B 23/00; E21B 29/06; E21B 23/02; E21B 7/061; E21B 17/06
See application file for complete search history.

(56) References Cited

U.S. PATENT DOCUMENTS

| | | | | |
|---|---|---|---|---|
| 9,140,083 | B2 * | 9/2015 | Delgado | E21B 29/06 |
| 12,188,312 | B2 * | 1/2025 | Munir | E21B 23/01 |
| 2009/0266544 | A1 * | 10/2009 | Redlinger | E21B 47/09 166/298 |
| 2014/0116699 | A1 | 5/2014 | Helms et al. | |
| 2015/0034339 | A1 | 2/2015 | James et al. | |
| 2021/0301610 | A1 | 9/2021 | Nguyen et al. | |
| 2023/0129281 | A1 | 4/2023 | Nguyen | |
| 2024/0271496 | A1 | 8/2024 | Munir | |

OTHER PUBLICATIONS

Notification of Transmittal of the International Search Report and the Written Opinion of the International Searching Authority, or the Declaration; PCT/US2025/043461; Mail Date: Dec. 18, 2025; 8 pages.

* cited by examiner

*Primary Examiner* — Zakiya W Bates
(74) *Attorney, Agent, or Firm* — CANTOR COLBURN LLP

(57) ABSTRACT

A mill, whipstock, and anchor assembly, including a mill, a whipstock attached to the mill, an anchor attached to the whipstock, the anchor having a kinetic energy releaser, the releaser including an energetic material, and a sensor in the assembly, the sensor configured to respond to a selected parameter by sending a first signal. A method for setting an anchor of the assembly, the method including causing a condition to exist at the sensor that at least reaches a threshold for the sensor to generate the first signal, igniting the energetic material, disappearing the releaser, and applying kinetic energy to a slip to set the anchor. A borehole system, including a borehole in a subsurface formation, a string disposed in the borehole, and the mill, whipstock, and anchor assembly disposed within or as a part of the string.

18 Claims, 7 Drawing Sheets

MILL, WHIPSTOCK, AND ANCHOR ASSEMBLY, METHOD AND SYSTEM

BACKGROUND

In the resource recovery and fluid sequestration industries, it is often necessary to exit a casing in order to prepare a lateral borehole. This is commonly accomplished by using a whipstock assembly including an anchor. The anchor is set against the casing and maintains the whipstock in position as a mill works its way along the whipstock and through the casing. While a number of different types of assemblies and setting regimes are available for such operations, they remain less than optimally efficient due to various conditions that are commonly experienced. Increased efficiency is always desirable in the art.

SUMMARY

An embodiment of a mill, whipstock, and anchor assembly, including a mill, a whipstock attached to the mill, an anchor attached to the whipstock, the anchor having a kinetic energy releaser, the releaser including an energetic material, and a sensor in the assembly, the sensor configured to respond to a selected parameter by sending a first signal.

An embodiment of a method for setting an anchor of the assembly, the method including causing a condition to exist at the sensor that at least reaches a threshold for the sensor to generate the first signal, igniting the energetic material, disappearing the releaser, and applying kinetic energy to a slip to set the anchor.

An embodiment of a borehole system, including a borehole in a subsurface formation, a string disposed in the borehole, and the mill, whipstock, and anchor assembly disposed within or as a part of the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
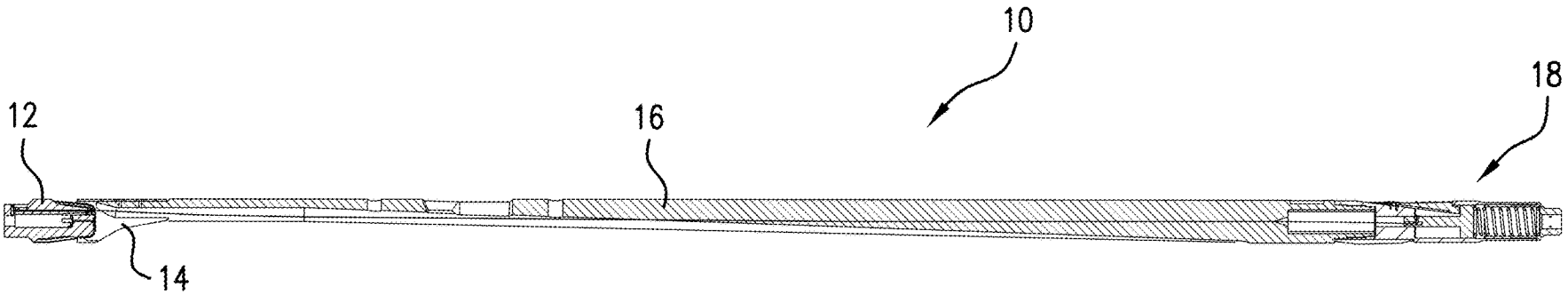
FIG. 1 is a high level sectional view of the mill, whipstock, and anchor assembly as disclosed herein.

Referring to FIG. 1, a mill, whipstock, and anchor assembly 10 is illustrated to show relative positions and identify the environment of the disclosed assembly. Assembly 10 includes a mill 12, a mill engagement section 14, a whipstock 16, and an anchor 18.

Figure 2:
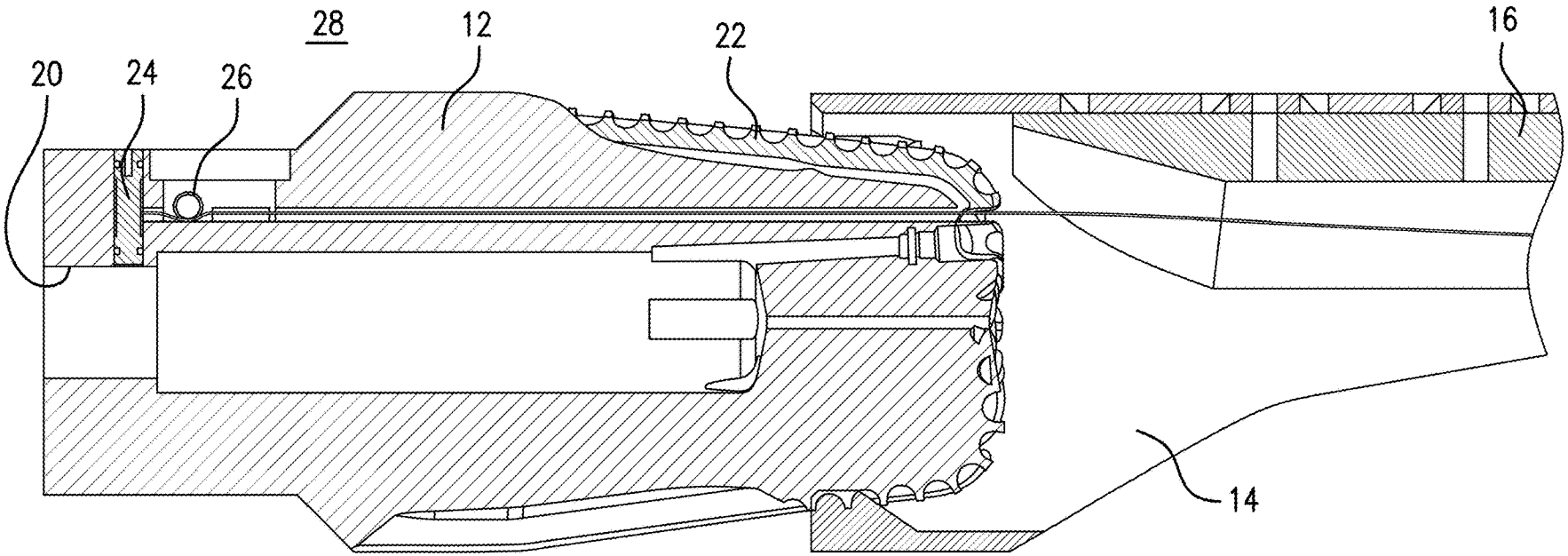
FIG. 2 is an enlarged sectional view of the mill and mill engagement section of FIG. 1.

Referring to FIG. 2, an enlarged sectional view of the mill 12 and mill engagement section 14 is illustrated. The mill 12 defines a bore 20 and supports a cutting surface 22. The mill 12 may include a sensor 24 and electronics 26 operably connected to the sensor 24. The electronics may include processors and or power source components such as batteries or cables from remote electrical energy sources. The sensor 24 may be configured to be sensitive to any property desired including but not limited to pressure. The sensor 24 may be open to pressure in the bore 20, in an annular volume 28 radially outwardly of the mill 12, or both as desired. The sensor 24 is configured with a threshold level of the sought property. If pressure is used, the sensor 24 is configured to generate or convey a first signal when the threshold pressure is reached, be that pressure in the bore 20, the annular volume 28, both, or a threshold differential between the two, in some cases with a blowout preventer 29 in a closed on. The generated or conveyed first signal may be provided to the electronics 26, which then communicate further as discussed hereunder (a second signal), or that generated or conveyed first signal may itself cause events discussed hereunder.

Figure 3:
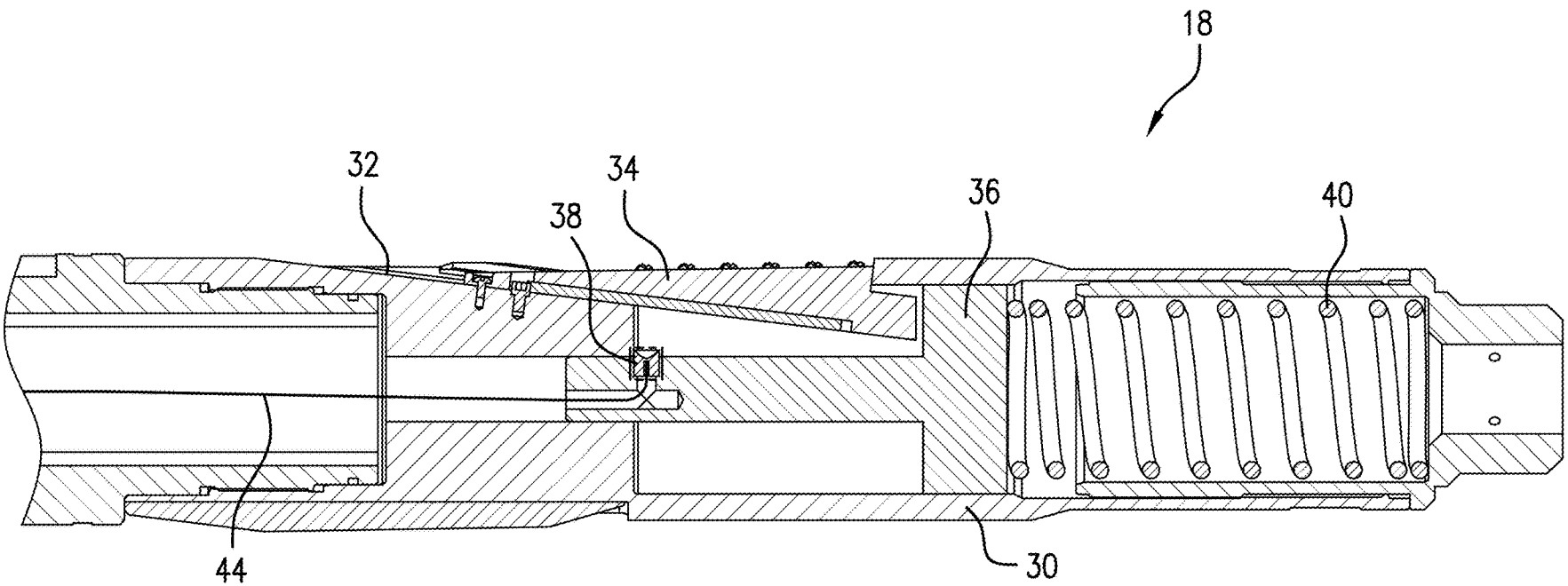
FIG. 3 is an enlarged sectional view of the anchor of FIG. 1.

Referring to FIG. 3, an enlarged cross section of the anchor 18 illustrated in FIG. 1 provides a better understanding of the various components therein. Anchor 18 comprises a housing 30 having a ramp 32 whereupon a slip 34 may be moved radially inwardly or radially outwardly dependent upon a direction of axial movement of the slip 34. A drive bar 36 is disposed in the housing 30 and is either prevented from moving by a kinetic energy releaser 38 or is permitted to move under the input of a spring 40 (which in the illustration of FIG. 3 is in a position where energy has been stored therein through compression of the spring 40) once the releaser 38 has released the drive bar 36. The spring 40 thus holds potential energy that is convertible to kinetic energy upon the release of the releaser 38. The kinetic energy upon such release is used to move the drive bar 36 in a direction associated with the slip 34 climbing the ramp 32 and thereby displacing radially outwardly into a set or partially set position. The releaser 38, which is illustrated in an enlarged view in FIG. 3A, includes an energetic material 42 therein that is responsive to the first or second signal (depending upon which signal is conveyed to the material 42). The signal to which the energetic material responds may be the first signal generated or conveyed by the sensor 24 or may be the second signal from the electronics 26, which itself may be due to reception of the first signal or due to programming, or due to another reason. It is to be appreciated that the first or second signals may be conveyed via a conductor 44 or wirelessly. In either case, the first or second signal causes ignition of the energetic material 42. It is to be appreciated that the energetic material may make up the entire releaser 38 or may make up only a portion of the releaser 38 with the balance of the releaser being susceptible to the ignition of the energetic material. For example, disappear-on-demand material, commercially available from Baker Hughes, may make up the balance of the releaser 38 and may burn away in response to ignition of the energetic material 42.

Figure 3A:
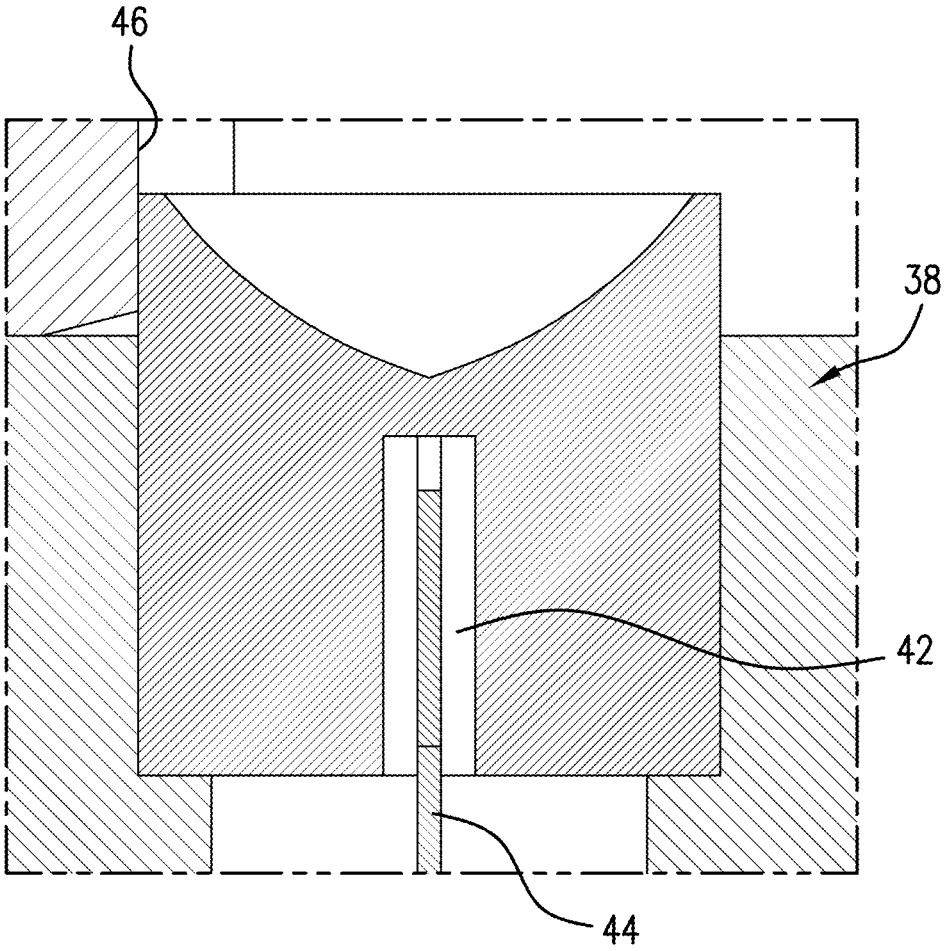
FIG. 3A is an enlarged view of the kinetic energy releaser.
Figure 4:
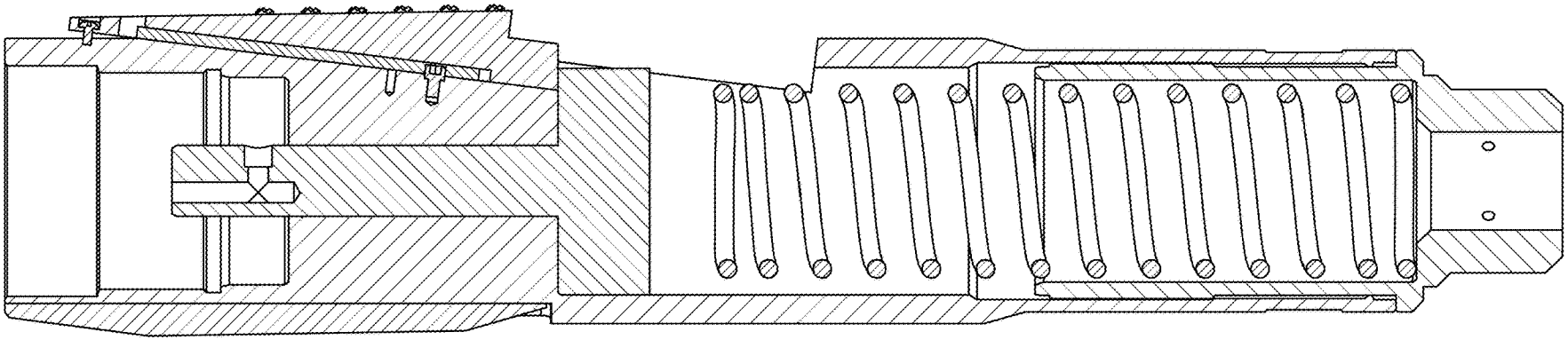
FIG. 4 an enlarged sectional view of the anchor of FIG. 1 in a set position.

As will be evident to those of skill in the art from a review of FIG. 3A, the housing 30 is configured with a shoulder 46 against which the releaser 38 will bear prior to ignition and release, the releaser thus holding the drive bar 36 against the potential energy stored in the spring 40. Upon release of the releaser 38, nothing prevents the spring 40 from pushing the drive bar 36 and so drive bar 36 moves, thereby setting the slip 34, which is illustrated in FIG. 4.

Figure 5:
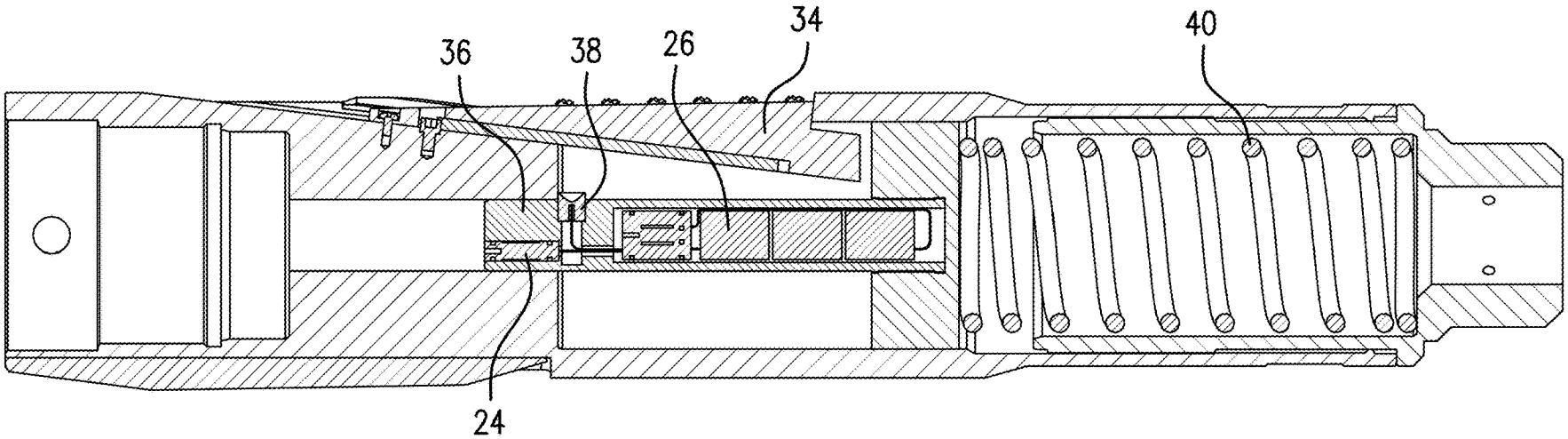
FIG. 5 is a sectional view of an alternate anchor portion of the mill, whipstock, and anchor assembly of FIG. 1.

In an alternate embodiment, referring to FIG. 5, the drive bar 36 is reconfigured to house the sensor 24 and in one configuration electronics 26. In this embodiment, the functions of each of the components including the sensor 24 remains the same (parameters to which the sensor is sensitive are merely in a different place) but there is no need for the conductor 44 to span the whipstock 16, resulting in less material for construction of the assembly 10.

Figure 6:
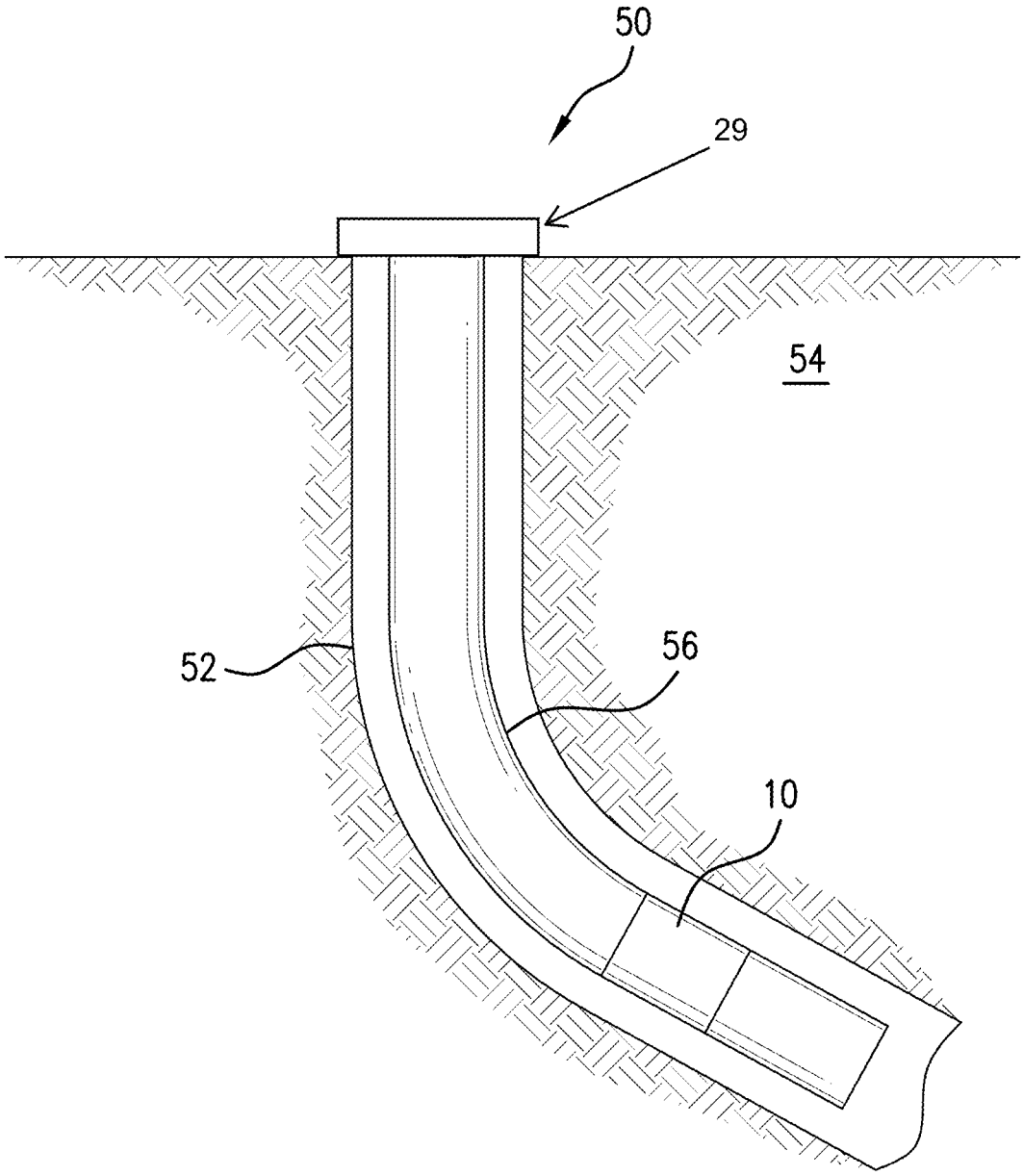
FIG. 6 is a view of a borehole system including the mill, whipstock, and anchor assembly as disclosed herein.

Referring to FIG. 6, a borehole system 50 is illustrated. The system 50 comprises a borehole 52 in a subsurface formation 54. A string 56 is disposed within the borehole 52. A mill, whipstock, and anchor assembly 10 as disclosed herein is disposed within or as a part of the string 56.

Set forth below are some embodiments of the foregoing disclosure:

Embodiment 1: A mill, whipstock, and anchor assembly, including a mill, a whipstock attached to the mill, an anchor attached to the whipstock, the anchor having a kinetic energy releaser, the releaser including an energetic material, and a sensor in the assembly, the sensor configured to respond to a selected parameter by sending a first signal.

Embodiment 2: The assembly as in any prior embodiment, wherein the first signal is an electric signal.

Embodiment 3: The assembly as in any prior embodiment, wherein the sensor is a pressure sensor.

Embodiment 4: The assembly as in any prior embodiment, wherein the sensor is located within the anchor.

Embodiment 5: The assembly as in any prior embodiment, wherein the sensor is located within the mill.

Embodiment 6: The assembly as in any prior embodiment, wherein the sensor senses one of pressure within the mill, pressure outside of the mill, or both pressure within and pressure outside of the mill.

Embodiment 7: The assembly as in any prior embodiment, wherein the releaser is a disappear-on-demand material.

Embodiment 8: The assembly as in any prior embodiment, wherein the disappear-on-demand material comprises an energetic material.

Embodiment 9: The assembly as in any prior embodiment, wherein the releaser responds directly to the first signal.

Embodiment 10: The assembly as in any prior embodiment, wherein the releaser responds to a second signal generated in an electronics package that generates the second signal in response to receipt of the first signal.

Embodiment 11: The assembly as in any prior embodiment, wherein the energetic material is configured to ignite a disappear-on-demand material.

Embodiment 12: The assembly as in any prior embodiment, wherein the releaser prior to release extends from a drive bar and interacts with an abutment surface of a housing of the anchor.

Embodiment 13: The assembly as in any prior embodiment, wherein the drive bar is in contact with a source of potential energy.

Embodiment 14: A method for setting an anchor of the assembly as in any prior embodiment, the method including causing a condition to exist at the sensor that at least reaches a threshold for the sensor to generate the first signal, igniting the energetic material, disappearing the releaser, and applying kinetic energy to a slip to set the anchor.

Embodiment 15: The method as in any prior embodiment, wherein the causing is pressurizing a volume of fluid to which the sensor is exposed.

Embodiment 16: The method as in any prior embodiment, wherein the pressurizing includes closing a blowout preventer.

Embodiment 17: The method as in any prior embodiment, wherein the applying includes releasing potential energy stored in a spring.

Embodiment 18: A borehole system, including a borehole in a subsurface formation, a string disposed in the borehole, and the mill, whipstock, and anchor assembly as in any prior embodiment disposed within or as a part of the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of +8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A mill, whipstock, and anchor assembly, comprising:

a mill;

a whipstock attached to the mill;

an anchor attached to the whipstock, the anchor having a kinetic energy releaser, the releaser including an energetic material; and a sensor in the assembly, the sensor configured to respond to a selected parameter by sending a first signal.

2. The assembly as claimed in claim 1, wherein the first signal is an electric signal.

3. The assembly as claimed in claim 1, wherein the sensor is a pressure sensor.

4. The assembly as claimed in claim 1, wherein the sensor is located within the anchor.

5. The assembly as claimed in claim 1, wherein the sensor is located within the mill.

6. The assembly as claimed in claim 5, wherein the sensor senses one of pressure within the mill, pressure outside of the mill, or both pressure within and pressure outside of the mill.

7. The assembly as claimed in claim 1, wherein the releaser is a disappear-on-demand material.

8. The assembly as claimed in claim 1, wherein the releaser is entirely an energetic material.

9. The assembly as claimed in claim 1, wherein the releaser responds directly to the first signal.

10. The assembly as claimed in claim 1, wherein the releaser responds to a second signal generated in an electronics package that generates the second signal in response to receipt of the first signal.

11. The assembly as claimed in claim 1, wherein the energetic material is configured to ignite a disappear-on-demand material.

12. The assembly as claimed in claim 1, wherein the releaser prior to release extends from a drive bar and interacts with an abutment surface of a housing of the anchor.

13. The assembly as claimed in claim 12, wherein the drive bar is in contact with a source of potential energy.

14. A method for setting an anchor of the assembly claimed in claim 1, the method comprising:

causing a condition to exist at the sensor that at least reaches a threshold for the sensor to generate the first signal;

igniting the energetic material;

disappearing the releaser; and applying kinetic energy to a slip to set the anchor.

15. The method as claimed in claim 14, wherein the causing is pressurizing a volume of fluid to which the sensor is exposed.

16. The method as claimed in claim 15, wherein the pressurizing includes closing a blowout preventer.

17. The method as claimed in claim 14, wherein the applying includes releasing potential energy stored in a spring.

18. A borehole system, comprising:

a borehole in a subsurface formation;

a string disposed in the borehole; and the mill, whipstock, and anchor assembly as claimed in claim 1 disposed within or as a part of the string.

* * * * *